US005648624A

United States Patent [19]

Smith

[11] Patent Number: 5,648,624

[45] Date of Patent: Jul. 15, 1997

[54] WIND CHIME HAVING A ROTATING STRIKER

[75] Inventor: Richard L. Smith, Charleston, S.C.

[73] Assignee: The Yancy Company, N. Charleston, S.C.

[21] Appl. No.: 503,915

[22] Filed: Jul. 19, 1995

[51] Int. Cl.[6] ..... G10D 13/08

[52] U.S. Cl. ..... 84/404; 116/141; D10/116

[58] Field of Search ..... 84/402, 404; 116/141, 116/169; D10/116, 119; D17/22, 99; 446/418

[56] References Cited

U.S. PATENT DOCUMENTS 4,693,162 9/1987 Lee ..... 84/404

5,452,638 9/1995 Yancy ..... 84/404

*Primary Examiner*—Cassandra C. Spyrou

*Attorney, Agent, or Firm*—B. Craig Killough

[57] ABSTRACT

A wind chime having a rotating striker. A rotating member is suspended from the striker. The rotating member is actuated by air currents or wind, which in turn, effect rotation of the striker. The striker strikes a multiplicity of chimes, producing musical tones.

5 Claims, 2 Drawing Sheets

WIND CHIME HAVING A ROTATING STRIKER

FIELD OF THE INVENTION

This invention relates to wind chimes.

BACKGROUND OF THE INVENTION

Wind chimes are devices which are hung or suspended, usually outdoors, and which produce musical tones as the device is moved about by the wind. Generally, a striker is connected to a clapper, and as the clapper is moved about by the wind, it causes the striker to be blown into and against chimes, producing musical tones.

Wind chimes are characterized by a frame which is hung or suspended so that movement of the wind chime is not impeded by other objects. A plurality of chimes, usually four or more, are suspended from the frame. Most commonly, the chimes are hollow metallic tubes which are suspended vertically from the frame in a manner which allows movement of the tubes relative to the frame and relative to each other.

The plurality of tubes forms a boundary as determined by their position of suspension from the frame. Generally, the hollow tubes are suspended equidistant from each other, so that, for example, if four tubes are used, the four tubes form the boundary of a square, while five tubes form the boundary of a pentagon, and so on. The chimes are capable of movement relative to each other, with little or no interference in the movement of the chimes caused by the remaining chimes. The striker is suspended, such as from the frame or from the hanging means of the wind chime, and is present within the interior of the boundary formed by the wind tubes, generally in the center of the boundary. The striker is allowed to swing freely so as to strike the plurality of chimes.

The movement of the striker to strike the chimes is influenced by the clapper. The clapper may be a disk or similar plane which is suspended horizontally to result in maximum exposure to the wind. As the wind contacts and pushes the clapper about, the striker is moved so as to strike the chimes to produce musical tones. The clapper may be decorative in shape or appearance.

The device is enhanced by the production of multiple tones. Various wind chimes are known in the art which use hollow tubes of varying dimensions form chimes which produce varying tones. The length or diameter of a hollow tube will affect the musical tone produced, and produce multiple tones.

SUMMARY OF THE PRESENT INVENTION

The present invention is a wind chime having a striker which rotates so as to strike the chimes as it rotates. The rotation of the striker is actuated by the wind or other air currents which are present in the environment in which the device is placed.

The rotation of the striker is acheived by connection of the striker to a rotating member. The rotating member comprises members which catch the moving air, or air foils, and cause rotation of the rotating member as pressure of the air or wind strikes the air foils.

DETAILED DESCRIPTION OF THE PREFERRED EMBODIMENT

Figure 1:
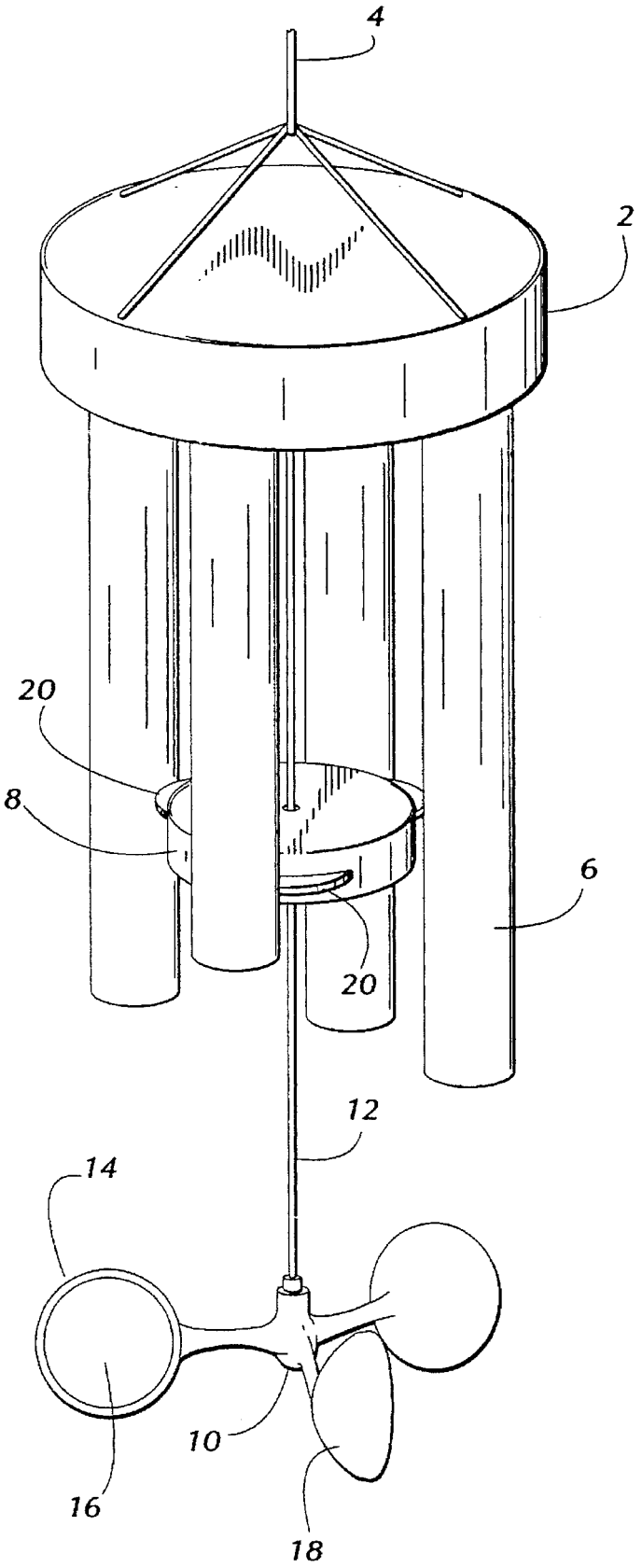
FIG. 1 is a perspective view of the wind chime.

Referring now to the drawing figures, FIG. 1 shows a wind chime. A frame 2 is suspended by means of a line 4. The line can be a string, rope, chain, rod or other similar flexible member from which objects are commonly hung, and which will support the weight of the wind chime.

The frame 2 as shown in FIG. 1 is an inverted bowl. The use of an inverted bowl collects and directs sound from the chimes. The frame could be any structure which can be hung or suspended, and from which a plurality of chimes may be hung or suspended.

As shown in FIG. 1, four chimes 6 are incorporated. Any number of chimes could be used. Most commonly, at least three chimes, but not more than six chimes, are used.

The chimes may be fabricated from hollow, metallic tubing. Tubing of the desired diameter is cut to the desired length. The metal tube which forms the chimes could be aluminum, copper, steel or other metal, or the tube could be fabricated from other materials which will produce a tone when struck by a striker. As shown in FIG. 1, the hollow tubes are cut to different lengths to form chimes having different tone characteristics.

Chimes are suspended from the frame. As shown, the chimes are suspended in a manner so that the chimes are allowed some freedom of movement relative to the frame. The optional use of the inverted bowl shaped frame shown in FIG. 1 not only collects and directs the sound, it also retains and limits movement of the chimes.

The tone of the wind chime is produced by the striker 8 striking the chimes. As the wind chime is exposed to the wind, the wind moves the chimes about so as to strike the striker, but more importantly, the striker is moved about by the wind so as to strike the chimes. The swinging motion of the wind chime, the individual chime members, and the movement of the striker, produces sound from the wind chime.

In the present invention, the striker is caused to rotate by movement of the air currents about the wind chime. In the preferred embodiment, rotating member 10 is suspended from the striker, and is suspended horizontally below the striker and the chimes, for maximum exposure to the wind or air currents. The wind strikes the rotating member, causing the striker to rotate and strike the wind chimes, due to the communication between the clapper and the striker.

The striker is suspended within the boundary formed by the position of the chimes on the frame. Most commonly, the chimes will be positioned equidistantly about the frame, so that as shown in FIG. 1, the four tubes form the corners of an imaginary square. The striker is within this boundary, and most commonly, is located at about the center of the boundary so formed.

The striker is suspended from a linkage which allows rotation of the striker. The striker may be suspended from the frame, or suspended from the line on which the wind chime is suspended, any one of which constitute its frame or mounting for the purpose of this application.

Figure 3:
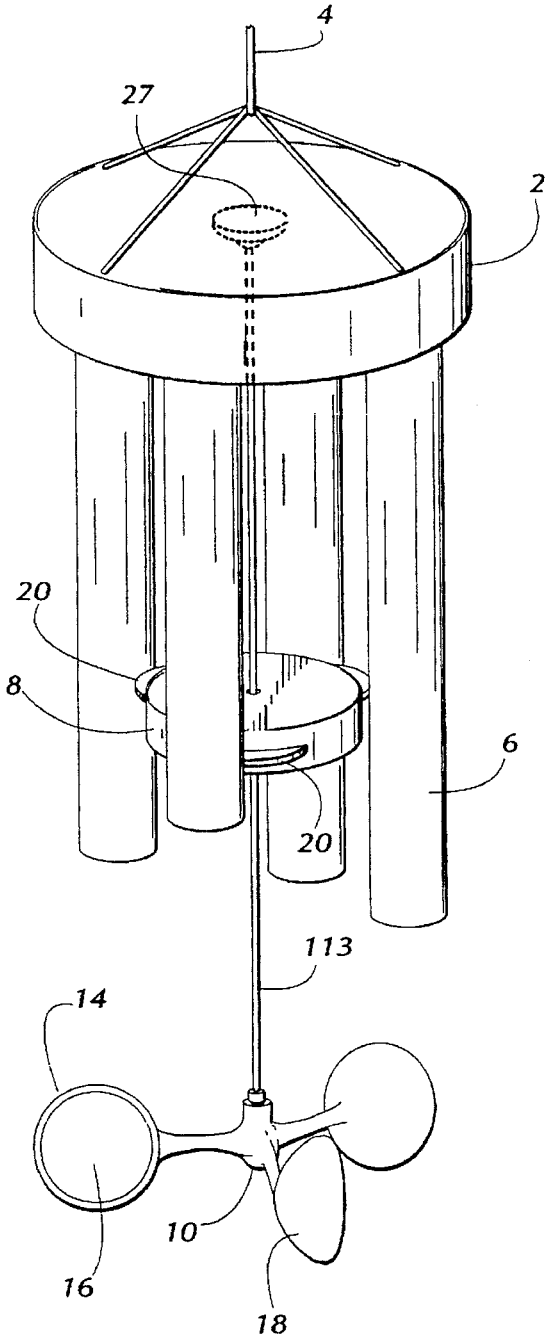
FIG. 3 is an additional embodiment of the wind chime.

The rotating member 10 is usually suspended so as to be positioned underneath the striker 8, although the striker could be otherwise positioned. The rotating member is connected to the striker by a linkage, 12 or 113, so that as the rotating member rotates due to the movement of the air, the striker rotates. If the striker is connected to the rotating member by means of a rigid linkage, such as a wire or rigid plastic link, as shown in FIG. 3, the striker and the rotating member will rotate in a 1:1 ratio. The linkage 113 may be mounted on an upper end of the linkage by a joint, or swivel, which allows rotation of the rotating member. The joint may comprise a bearing 27. The linkage may connect the joint to the striker, and may be rigid or flexible along its length, according to the characteristic desired.

Figure 2:
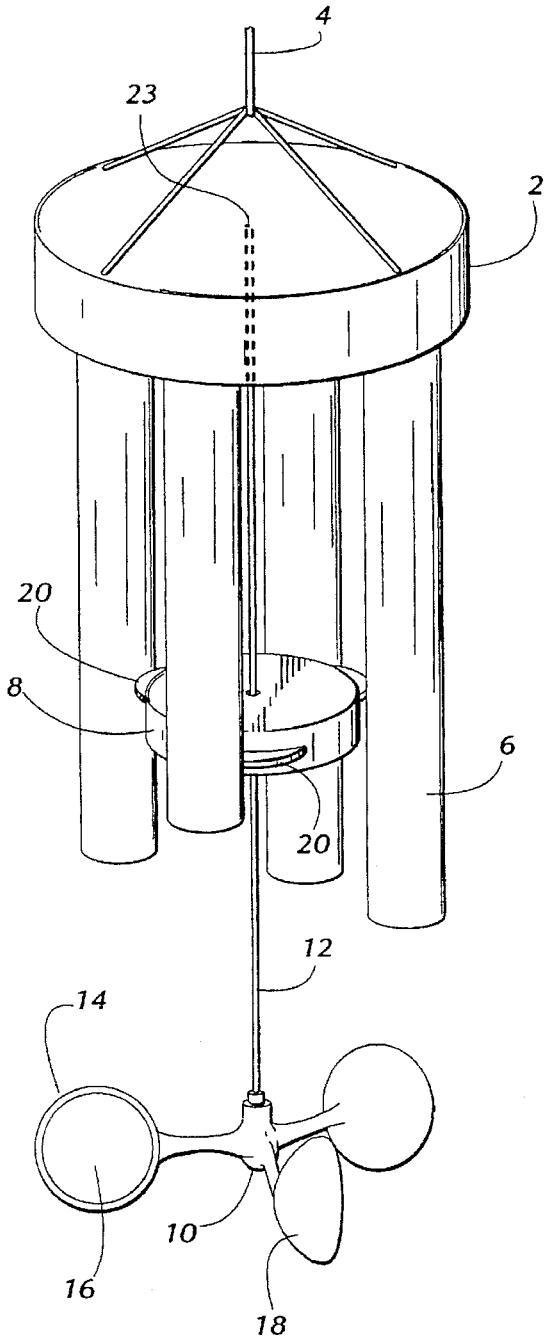
FIG. 2 is one embodiment of the wind chime.

The linkage 12 may be flexible along its length, as shown in FIG. 2, or along a portion of its length, by using a string, or cord, or similar material as a linkage. The linkage may be attached to the frame at a point 23, by fastening the linkage usually in a fixed manner, such as by tacking, tying, gluing or similarly fixing the linkage. The flexible linkage stores energy as it is rotated by the rotating member. If a flexible material is used as a linkage, the rotating member will spin faster than the striker, especially if no joint is incorporated, and the flexible linkage will tend to wind up, causing rotation of the striker both as the linkage winds up, and as it unwinds. The linkage may be attached to, or near, the frame on an upper end, and to the rotating member on the opposite end, while having the striker present intermediately along its length.

Air foils 14 extend from the rotating member. The air foils catch the wind in a manner which causes rotation of the rotating member. The air foils may be cups 16 which catch the wind on one surface, but which have less wind resistance on an opposite surface 18 so as to encourage rotation in one direction. A propellor shaped rotating member could be used. Other air foil shapes could be used. The rotating member in FIG. 1 will tend to rotate in a clockwise direction when viewed from the top.

Other configurations of the rotating member could be provided. Air foils having other configurations could be provided. A propellor shaped rotating member could be used. A turbine shape for the rotating member could be used.

As shown in FIG. 1, the striker 8 has a central member, which may be a round disk, which is positioned within the interior boundary formed by the chimes. Other configurations or shapes for the disk could be used. The disk may be comprised of a non-metallic material, such as a ceramic or wooden material, which has sufficient hardness to produce a tone from the chime when the non-metallic material strikes the chime, which is generally made of metal.

A plurality of members 20 may extend from the disk. The members may extend generally horizontally, or outwardly, from the central member, such as a side, of the striker. As the striker moves, the striker may contact a chime on a surface comprised of the striker which is comprised of one material to produce a tone, and subsequently on a different surface which is comprised of a different material to produce a differing tone.

Various configurations of the striker may be used. The surface of the striker may have varying material characteristics.

What is claimed is:

1. A wind chime having a rotating striker which is actuated by air currents, comprising:

a. frame;

b. at least one chime which is suspended from said frame;

c. at least one striker;

d. a linkage which is attached to said frame and to said at least one striker;

e. rotating means for causing said linkage to rotate and to wind up as moving air strikes said rotating means, and for causing said striker to rotate and strike said chime, wherein said rotating means is attached to said striker and has a multiplicity of air foils extending therefrom.

2. A wind chime as described in claim 1, wherein said striker comprises a central member having at least one additional member extending outwardly from said central member.

3. A wind chime as described in claim 1, wherein said at least one striker is suspended by means of said linkage.

4. A wind chime having a rotating striker which is actuated by air currents, comprising:

a. a frame;

b. at least one chime which is suspended from said frame;

c. a linkage;

d. means for attaching said linkage to said frame and allowing said linkage to rotate and swivel relative to said frame;

e. at least one striker which is suspended from above by means of said linkage; and f. rotating means for causing said linkage and said striker to rotate and swivel relative to said frame as moving air strikes said rotating means, wherein said rotating means is positioned below said striker and has a multiplicity of air foils extending therefrom.

5. A wind chime as described in claim 1, wherein said striker comprises a central member having at least one additional member extending outwardly from said central member.

* * * * *